US006151815A

United States Patent [19]

Cuzel et al.

[11] Patent Number: 6,151,815

[45] Date of Patent: Nov. 28, 2000

[54] WATER RESERVOIR FOR A STEAM IRON, AND METHOD FOR PRODUCING SUCH A RESERVOIR

[75] Inventors: Alain Cuzel; Pierre Blanchon, both of Saint Jean de Bournay, France

[73] Assignee: SEB S.A., Ecully, France

[21] Appl. No.: 09/381,583

[22] PCT Filed: Dec. 24, 1998

[86] PCT No.: PCT/FR98/02870

§ 371 Date: Sep. 22, 1999

§ 102(e) Date: Sep. 22, 1999

[87] PCT Pub. No.: WO99/37850

PCT Pub. Date: Jul. 29, 1999

[30] Foreign Application Priority Data

Jan. 23, 1998 [FR] France ..... 98/00945
Jun. 10, 1998 [FR] France ..... 98/07473

[51] Int. Cl.[7] ..... D06F 75/18

[52] U.S. Cl. ..... 38/77.8; 277/627

[58] Field of Search ..... 38/88, 77.8, 91, 38/74, 77.3, 77.82, 77.83; 277/609, 627, 630, 647

[56] References Cited

U.S. PATENT DOCUMENTS

| | | | |
|---|---|---|---|
| 2,883,778 | 4/1959 | Kistner | 38/77.6 |
| 4,115,935 | 9/1978 | Toft . | |
| 4,190,762 | 2/1980 | Santiago et al. . | |
| 4,484,399 | 11/1984 | Biancalani | 38/77.3 |
| 4,532,411 | 7/1985 | Terraillon et al. | 38/77.8 X |
| 4,686,352 | 8/1987 | Nawrot et al. | 38/88 X |
| 5,071,143 | 12/1991 | Byerly et al. | 277/627 |
| 5,222,746 | 6/1993 | Van Steenbrugge | 277/627 |
| 5,345,704 | 9/1994 | Guillot et al. . | |
| 5,398,424 | 3/1995 | Biancalani | 38/77.8 X |
| 5,671,927 | 9/1997 | Schwiger | 277/627 |
| 5,799,421 | 9/1998 | Bouleau et al. . | |

FOREIGN PATENT DOCUMENTS

| | | |
|---|---|---|
| 569 822 | 11/1993 | European Pat. Off. . |
| 2 391 310 | 12/1978 | France . |
| 2 747 404 | 10/1997 | France . |
| 491 759 | 9/1938 | United Kingdom . |

*Primary Examiner*—Ismael Izaguirre
*Attorney, Agent, or Firm*—Browdy and Neimark

[57] ABSTRACT

A pressing iron reservoir composed of a lower half-shell having at least one annular conformation and an upper half-shell having at least one annular conformation provided to interengage in and/or above the corresponding annular conformation of the lower half-shell. At least one of the conformations is formed with a covering attached in an irreversible manner and serving as a seal.

23 Claims, 8 Drawing Sheets

WATER RESERVOIR FOR A STEAM IRON, AND METHOD FOR PRODUCING SUCH A RESERVOIR

TECHNICAL FIELD

The present invention relates to the technical field of steam irons. The present invention concerns more particularly steam irons of a type comprising a steam chamber as well as a reservoir intended to receive and store water before it is injected by different known means such as needles, taps or pumps into said steam chamber in order to be vaporized therein.

PRIOR ART

In known steam irons of the above-cited type, the water reservoir is generally made according to one of the following arrangements.

The water reservoir can constitute a stand-alone assembly. The iron then comprises a sole plate surmounted by a heating body in which a steam chamber is arranged, a thermal screen disposed above the heating body, the water reservoir then being disposed above said screen. The water reservoir is in this case most often constructed by means of two half-shells assembled together in a manner to form a hollow body. This hollow body can contain elements intended for various functions such as for example to guide the water in order to supply the pumps, or even to contain elements such as resins for treatment of the water. The hollow body is designed in a manner to leave at least one filling opening for the water. In an advantageous manner, this hollow body is made of polypropylene, the two half-shells being assembled by welding.

Such a form of construction presents the drawback of being relatively costly. The reservoir being made in an independent manner, it is necessary to mold each of the component pieces, then to assemble by welding and finally to verify at this stage good water tightness of the assembly.

Such a form of construction presents equally the drawback of multiplying the risk of failure by water leakage, whether this occurs immediately after construction of the reservoir, or after a certain period of use. In effect it is difficult to assure and to maintain water tightness between the polypropylene reservoir bottom and the steam chamber because of the relative softness of the polypropylene at temperatures close to its operating limit.

The water reservoir can also be obtained by assembling a half-shell forming an upper part of the reservoir with a piece playing at the same time the role of lower part of the reservoir and of thermal screen.

In this latter case there is presented the problem of producing this assembly in a manner that is durably water tight and at a competitive cost with respect to other solutions. The thermal screen, as regards its function, is preferably made of a thermally isolating material which has a good temperature resistance such as a phenolic resin or polyester. The upper part of the reservoir being made most often of a thermoplastic material, preferably transparent, it is then not possible to create the connection with the lower part by welding. The known solutions consist then in providing a peripheral groove, generally in the thermal screen, interposing in said groove a liquid resin or silicone, or even solid seals of the silicone or rubber type, these latters being able to be obtained by molding or extrusion. The document FR2 747 404 describes such a solution. The assembly can be equally completed by one or several screws. None of these solutions permits obtaining a simple and economical assembly.

SUMMARY OF THE INVENTION

The object of the present invention is to alleviate the above-cited drawbacks and to achieve the assembly of an upper reservoir part with a lower reservoir part forming a thermal screen in a simple, reliable and economical manner.

This object is achieved with a steam iron reservoir comprising a lower half-shell composed of at least one annular conformation and an upper half-shell comprising at least one annular conformation provided to interlock in and/or around the corresponding annular conformation of the lower half-shell, characterized in that at least one of these conformations is made with a covering fixed in a non-reversible manner and serving as a seal.

The reservoir obtained presents a high reliability with respect to water tightness. This result is obtained by the fact that the covering or coverings serving as a seal adhere to one of the half-shells. This adherence presents two effects which combine to bring about the good water tightness of the assembly. First of all, it eliminates leaks between the seal or seals and the half-shell to which it is attached, in particular those which would result from a defect in the contact surfaces. Then, it allows a maximum transverse gripping on the seal or seals, the assembly being able to be made in a press under high pressure, the non-reversible connection of the seal with one of the pieces permitting avoidance of sliding and extrusion.

This form of construction permits a stand-alone and transportable assembly to be obtained without risk, notably for the subsequent fabrication process. This characteristic permits the assembly process of the pressing iron to be facilitated while permitting screw assembly to be postponed or even eliminated.

According to a first embodiment, the annular conformation or conformations arranged on the lower half-shell is a groove, and the corresponding annular conformation or conformations of the upper half-shell is a skirt.

According to a second embodiment, the annular conformation or conformations arranged in the lower half-shell is a skirt and the corresponding annular conformation or conformations of the upper half-shell is a groove.

According to a first variant, the covering or coverings serving as a seal is disposed in the groove or grooves.

According to a second variant, the covering or coverings serving as a seal is disposed in the skirt or skirts.

Advantageously, the covering or one of the coverings serving as a seal has a thickness between 0.5 and 5 mm.

Advantageously the covering or coverings serving as a seal is made of "EPDM."

According to an advantageous form of construction, the lower half-shell comprises a first annular conformation and a second annular conformation adjacent to the first annular conformation, and the upper half-shell comprises a first annular conformation and a second annular conformation adjacent to the first annular conformation.

According to another advantageous form of construction, the lower half-shell comprises a peripheral annular conformation and an interior annular conformation, and the upper half-shell comprises a peripheral annular conformation and an interior annular conformation.

The invention also concerns a process for producing a pressing iron reservoir in which the covering or coverings serving as a seal is obtained by overmolding on the annular conformation or conformations. This form of construction permits an optimal quality of assembly to be obtained without requiring significant investments such as that for a bi-injection press, even if the overmolding of the seal requires a return operation.

The invention equally concerns a process for producing a pressing iron reservoir in which the covering or coverings serving as a seal is obtained with one of the half-shells by bi-injection molding.

This solution optimizes the fabrication costs since one of the half-shells and the covering or coverings serving as a seal are obtained in a single injection operation.

Advantageously the conformation or conformations oppose to that formed with the covering or coverings serving as a seal have at least one vent channel.

In effect when one exerts an insertion pressure on one of the half-shells in order to install the seal in the annular conformation of the opposed half-shell, air is trapped between the seal and the annular conformation. Now the establishment from the time of fabrication of the assembly of a pressure opposed to the direction in which one desires to the contrary to maintain the half-shells is detrimental. The pressure existing at ambient temperature is going to increase when the air trapped between the seal and the lower half-shell is heated during utilization of the pressing iron. By way of example it has been calculated that a force greater than 1,000 N could be applied in an upward direction on the upper half-shell.

A vent channel permits avoidance of the creation of an opposing pressure at the interior of the assembly, detrimental to a device which has to work at a temperature. It is no longer necessary to mold the annular conformation of the half-shell opposed to that carrying the covering without a strip-off slope in order to avoid relatively large insertion forces risking partial destruction of the half-shells. This advantage is desirable since the molding without a strip-off slope complicates and increases the cost of the molding operations. It is not necessary either to overdimension the annular conformations in order for these to resist the forces exerted. The assembly obtained is less costly, stronger and more durable.

The invention also concerns a process for producing a pressing iron reservoir in which the vent channel or channels comes to be blocked after the assembly of the upper half-shell on the lower half-shell.

Such a form of construction permits the benefits of a greater freedom in the implantation of the vent channels, forming free passages for the evacuation of air during operation of the assembly. In particular, the vent channels can open into the zone of the reservoir provided to receive water. Their blockage permits the inconveniences connected with the presence of water under the seal to be avoided.

The invention equally concerns a process for forming a pressing iron reservoir consisting in carrying out the assembly operation of the lower half-shell with the upper half-shell under partial vacuum.

Such a process permits obtaining an assembly which is less costly, stronger and more durable, the rarefied air not creating strong forces on the conformations during the insertion of the upper half-shell into the lower half-shell.

BRIEF DESCRIPTION OF THE DRAWINGS

The invention will be better understood from a study of the examples of embodiments taken by way of nonlimiting example and illustrated in the attached figures in which.

BEST MANNER OF CARRYING OUT THE INVENTION

Figure 1:
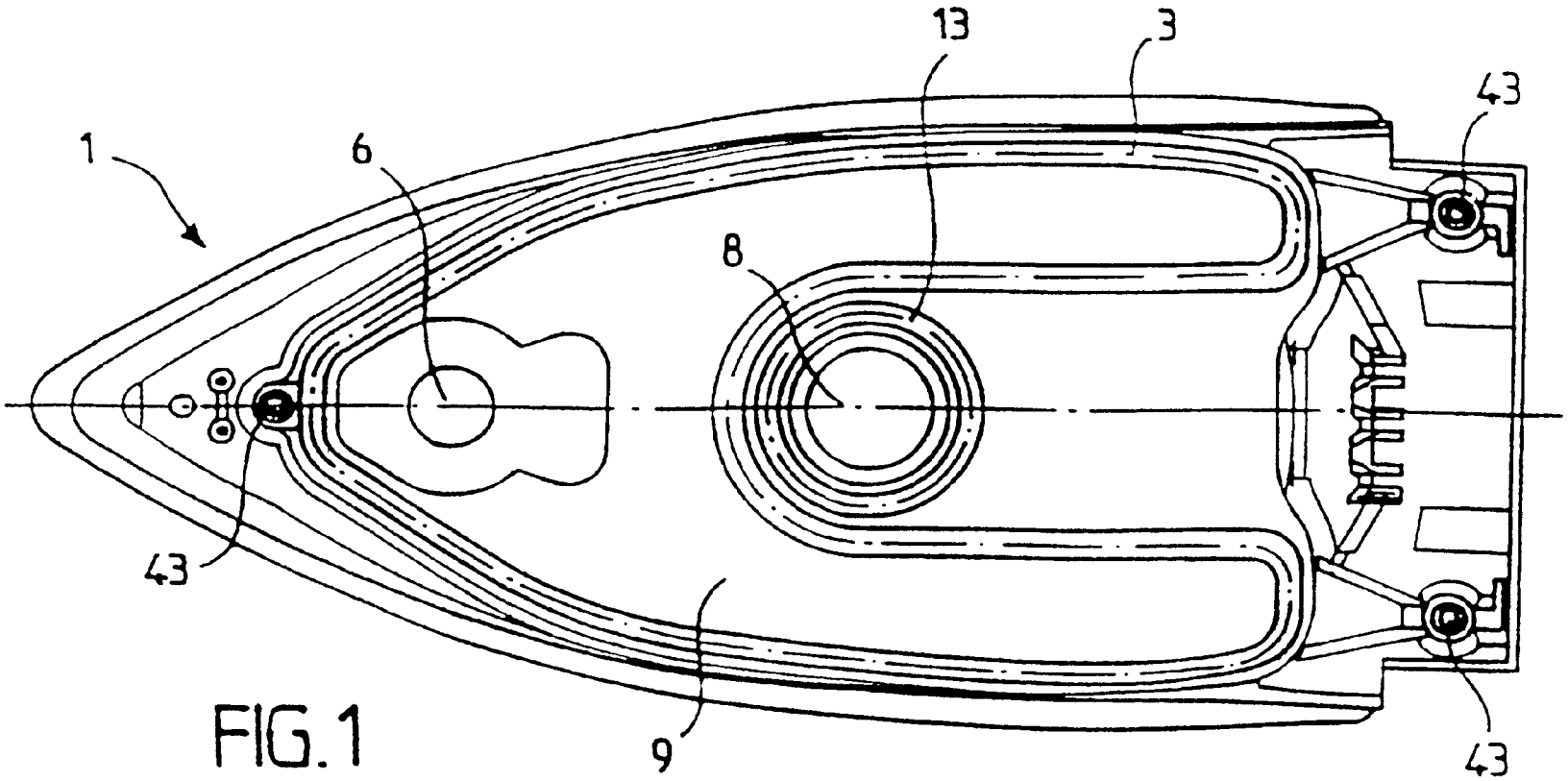
FIG. 1 is a schematic top view of a first example of an embodiment of a lower half-shell of a reservoir according to the invention.

The pressing iron reservoir according to the invention comprises a lower half-shell composed of at least one annular conformation. According to the embodiment examples shown in FIGS. 1 and 4, lower half-shell 1; 11 is composed of two annular conformations 3, 13; 23, 33, each formed by a groove.

The pressing iron reservoir according to the invention equally comprises an upper half-shell composed of at least one annular conformation, called an associated annular conformation, provided to interengage in and/or over the corresponding annular conformation of the lower half-shell. According to the embodiment examples shown in FIGS. 2 and 5, upper half-shell 2; 12 comprises two annular conformations for 4, 14; 24, 34, each formed by a skirt.

By way of a variation, not shown in the figures, one of the annular conformations arranged on the lower half-shell is a skirt and the corresponding annular conformation of the upper half-shell is a groove.

Preferably the reservoir comprises two annular conformations 3, 13; 23, 33; 4, 14; 24, 34 on each of the half-shells 1; 11; 2; 12, as shown in the figures. This arrangement permits forming passages 7; 17 in upper half-shell 2; 12 and passages 8; 18 in lower half-shell 1; 11, for thermostat controls, for example.

Figure 2:
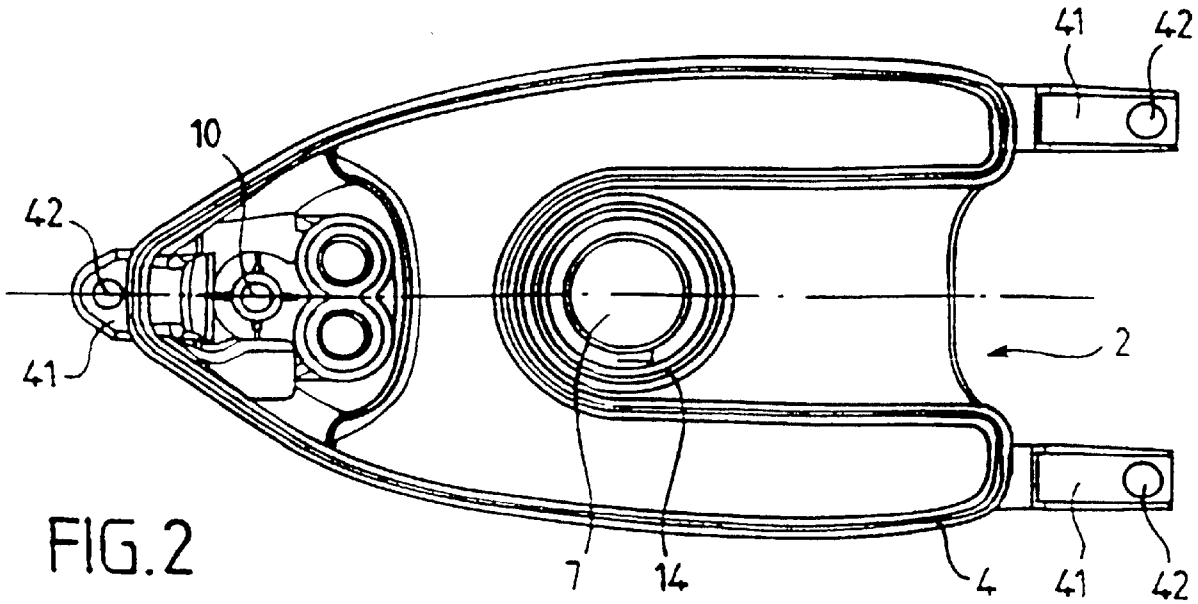
FIG. 2 is a schematic bottom view of a first example of an embodiment of an upper half-shell of a reservoir according to the invention.
Figure 3:
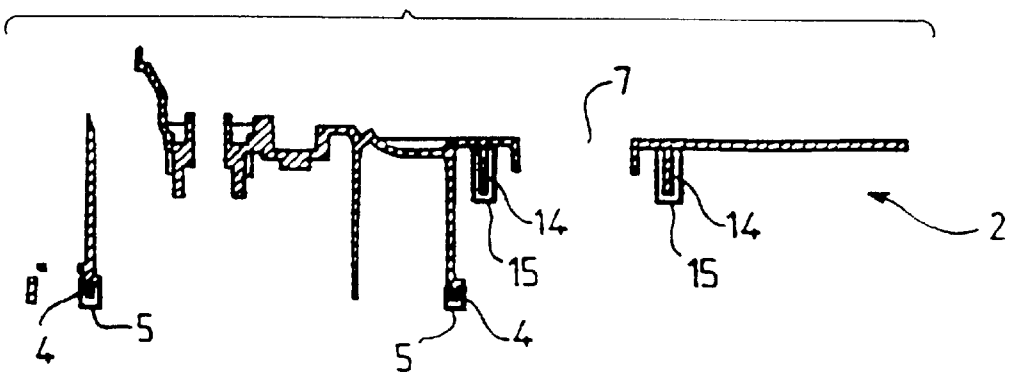
FIG. 3 is schematic side view in the cross section of a first example of an embodiment of an upper half-shell of a reservoir according to the invention.

FIGS. 1, 2 and 3 show a first form of construction, called adjacent, in which lower half-shell 1 and upper half-shell 2 each comprise a first annular conformation 3; 4 and a second annular conformation 13; 14 adjacent to the first annular conformation 3; 4.

As shown in FIG. 1, annular conformation 3 of lower half-shell 1 delimits a reservoir forming cavity 9, said cavity comprising an orifice 6 provided for the passage of a needle (not shown in the figures) intended for supplying the steam chamber of an iron. Upper half-shell 2 shown in FIG. 2 equally comprises an orifice 10 provided for the passage of the needle.

Figure 4:
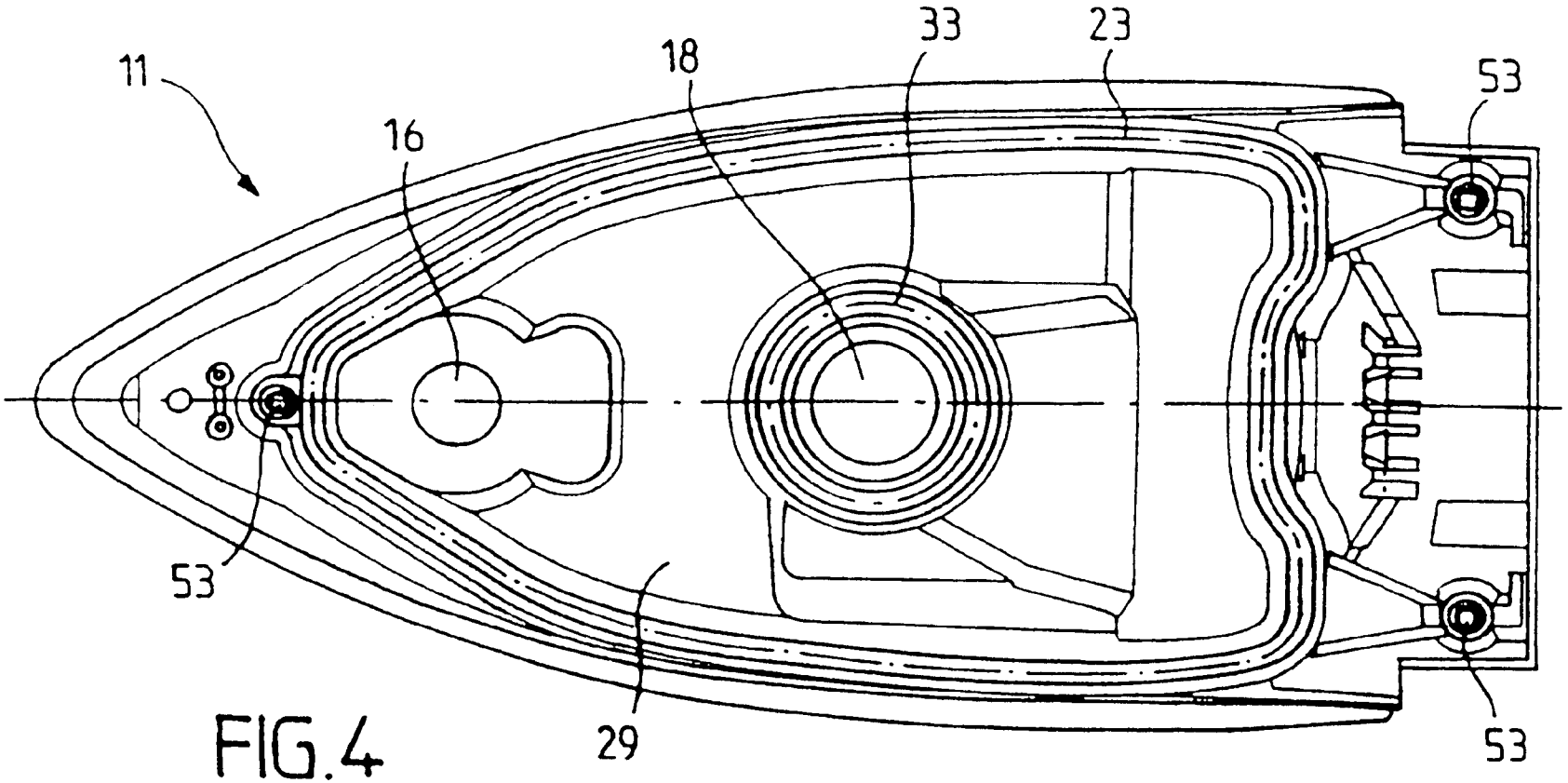
FIG. 4 is a schematic top view of a second example of an embodiment of a lower half-shell of a reservoir according to the invention.
Figure 5:
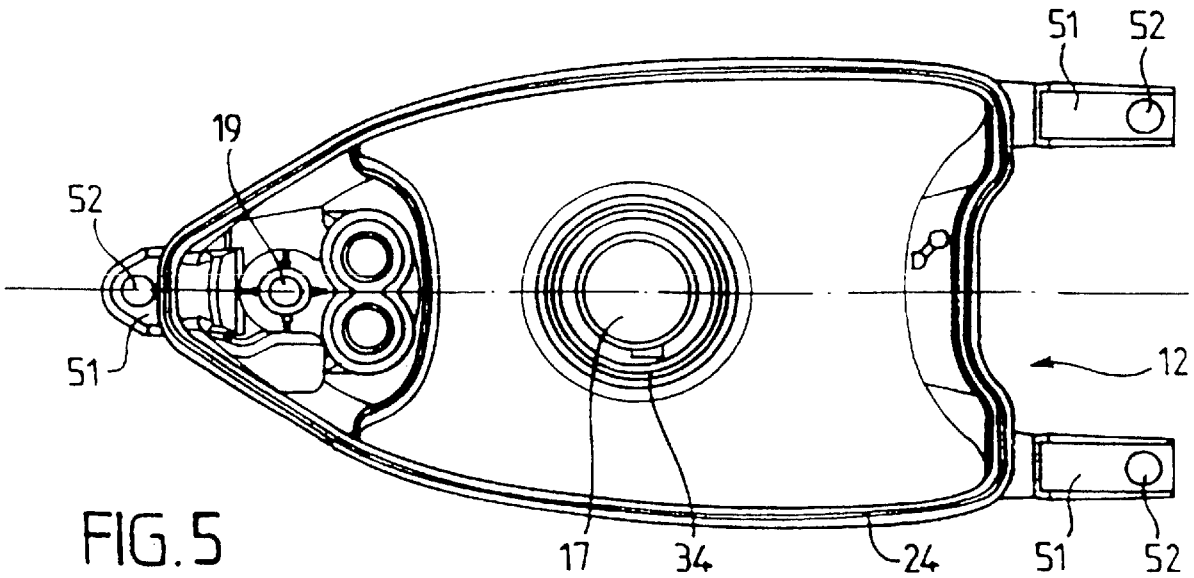
FIG. 5 is a schematic bottom view of a second example of an embodiment of an upper half-shell of a reservoir according to the invention.
Figure 6:
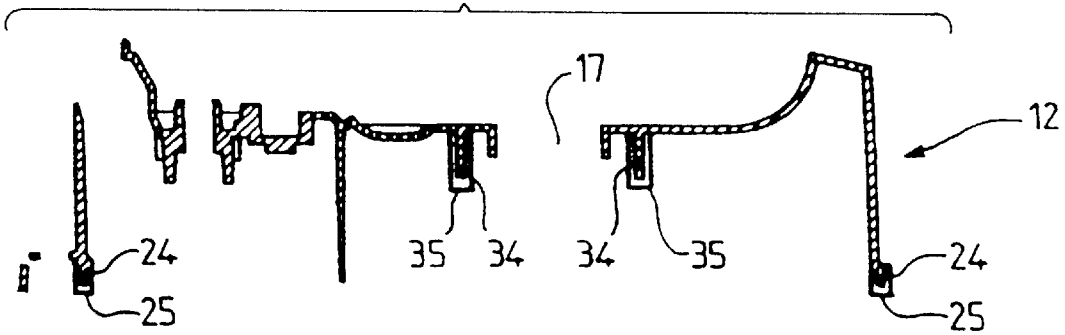
FIG. 6 is a side view in cross-section of a second example of an embodiment of an upper half-shell of a reservoir according to the invention.

FIGS. 4, 5 and 6 show a second form of construction, called concentric, in which the lower half-shell 11 and upper half-shell 12 each comprise a peripheral annular conformation 23; 24 and an interior annular conformation 33; 34.

As shown in FIG. 4, peripheral annular conformation 23 and interior annular conformation 33 of lower half-shell 11 delimit a reservoir forming cavity 29, said cavity comprising an orifice 16 provided for the passage of a needle (not shown in the figures) intended for supplying the steam chamber of an iron. Upper half-shell 12 equally comprises an orifice 19 provided for passage of the needle.

As a variant, it is envisionable to form a reservoir each of the half-shells of which comprises only one annular conformation, or to the contrary, more than two annular conformations.

According to the invention, at least one of these conformations is produced with a covering serving as a seal.

Advantageously, according to the form of construction called adjacent, one example of which construction is shown in FIGS. 1 to 3 a first covering serving as seal 5 is disposed on first annular conformation 4 of upper half-shell 2, and a second covering serving as seal 15 is disposed on second annular conformation 14 of upper half-shell 2. By way of a variation when one of the annular conformations of upper half-shell 2 is a groove and not a skirt the corresponding covering is disposed in said groove.

Advantageously, according to the form of construction called concentric, an example of which construction is shown in FIGS. 4 to 6 a covering serving as seal 25 is disposed on peripheral annular conformation 24 of upper half-shell 12, and another covering serving as seal 35 is disposed on interior annular conformation 34 of upper half-shell 12. By way of variation when one of the annular conformations of upper half-shell 12 is a groove and not a skirt the corresponding covering is disposed in said groove.

As shown in FIGS. 2 and 3, the skirts forming annular conformations 4, 14 of upper half-shell 2 are produced with a covering serving as seal 5, 15. As shown in FIGS. 5 and 6, the skirts forming annular conformations 24, 34 of upper half-shell 12 are produced with a covering serving as seal 25, 35.

More particularly, according to the forms of construction shown in FIGS. 3 and 6, each seal 5, 15; 25, 35 is fixed on the extremity of each associated annular conformation formed by one of skirts 4, 14; 24, 34. Each seal 5, 15; 25, 35 is able to cooperate by clamping with the corresponding annular conformation formed by grooves 3, 13; 23, 33.

According to one variant, not shown in the figures, at least one of the coverings serving as a seal is disposed in one of the grooves. Said groove can belong to one of the annular conformations of the upper half-shell like that of the lower half-shell.

Advantageously, one of the coverings serving as seal 5, 15; 25, 35 has a thickness between 0.5 and 5 mm. Preferably, all of the coverings have these characteristics.

Advantageously, one of the coverings serving as seal 5, 15; 25, 35 is made of EPDM. Other materials, such as silicones or neoprene rubber, are possible, and in a more general manner any material capable of withstanding temperatures of the order of 100° C. to 150° C. while retaining elastic characteristics and a substantial compressibility.

Lower half-shell 1; 11 is preferably made of a material that can withstand temperatures of at least 200° C., such as a resin. Such a material presents in addition the advantage of not being a good conductor of heat. Upper half-shell 2; 12 is preferably made of a thermoplastic material preferably transparent.

Each associated annular conformation of the upper half-shell is capable of cooperating with the corresponding annular conformation arranged in the lower half-shell. More particularly, according to the construction examples shown in the figures, each skirt 4, 14; 24, 34 is provided to be inserted into the corresponding groove 3, 13; 23, 33.

The relative dimensions of each associated annular conformation such as one of skirts 4, 14; 24, 34, each seal 5, 15; 25, 35 and each corresponding annular conformation such as one of grooves 3, 13; 23, 33 are provided to obtain a relative pressure in a direction substantially perpendicular to the assembly direction. This lateral pressure can be even greater as one is capable of performing assembly of the upper part with its seal on the lower part with a substantial force and this without risk that the seal will be displaced during this operation. To the extent where a compression of 10% to 30% of seals 5, 15; 25, 35 in the lateral direction is sought each groove 3, 13; 23, 33 can have a width of 3 to 10 mm and each of the walls of the seal between skirt and groove a thickness of 0.5 to 5 mm.

Advantageously, lower half-shell 1; 11 and upper half-shell 2; 12 comprise complementary fastening means. As shown in FIGS. 1, 2, 4 and 5, upper half-shell 2; 12 comprises lugs 41; 51 each having an orifice 42; 52 capable of coming opposite housings 43; 53 arranged in lower half-shell 1; 11. Orifices 42; 52 and housings 43; 53 are provided for a screw assembly. A different number of lugs 41; 51 or another manner of assembling are equally envisionable.

The invention equally concerns a process for producing a pressing iron reservoir comprising said lower 1; 11 and upper 2; 12 half-shells.

The process according to the invention consists in producing a covering serving as a seal on one of the annular conformations before assembling lower half-shell 1; 11 with upper half-shell 2; 12. This comes to fix in an irreversible manner a seal on said conformation.

Figure 7:
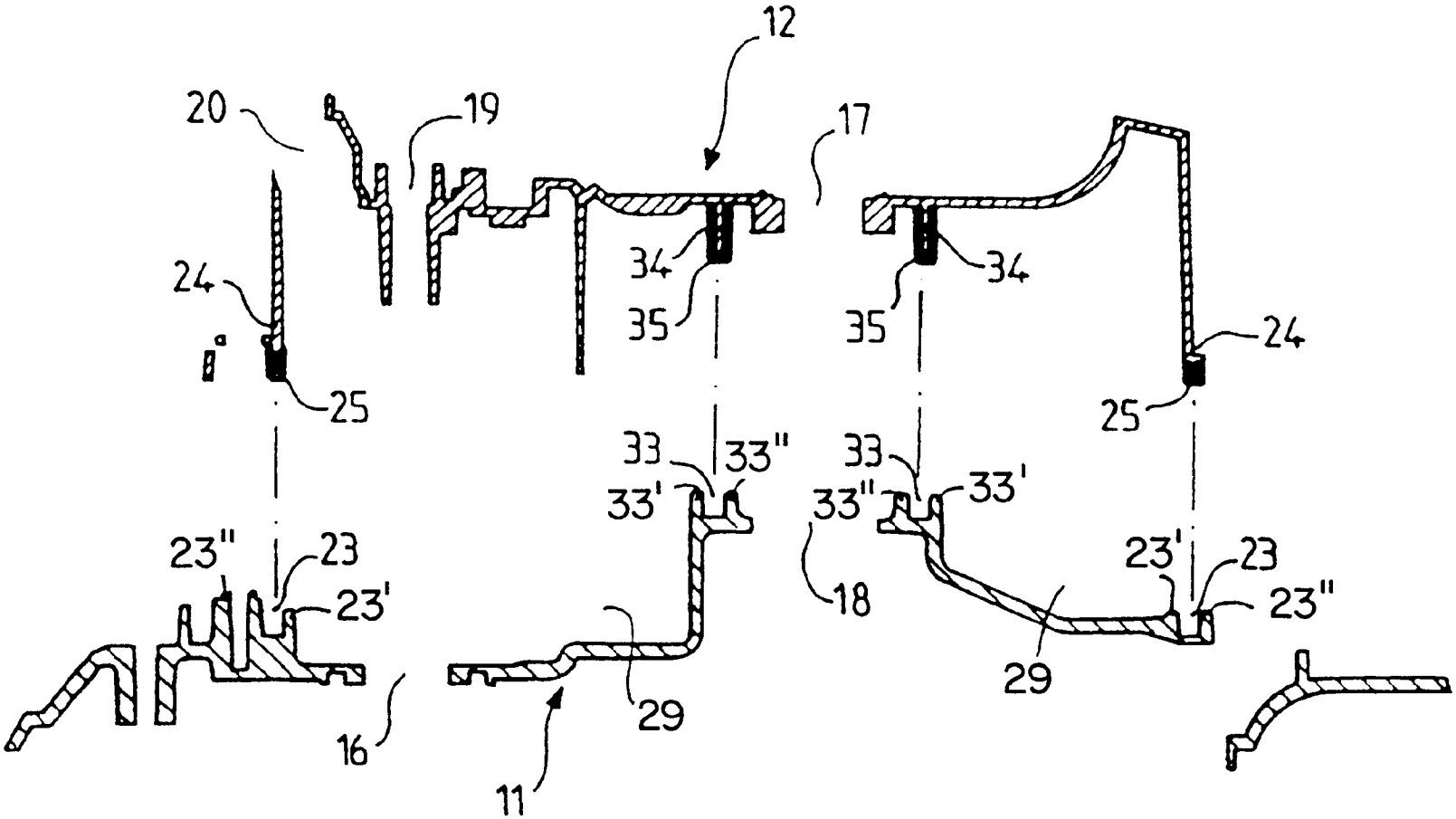
FIG. 7 is a side view in cross-section of a reservoir according to the second embodiment, before assembly.
Figure 8:
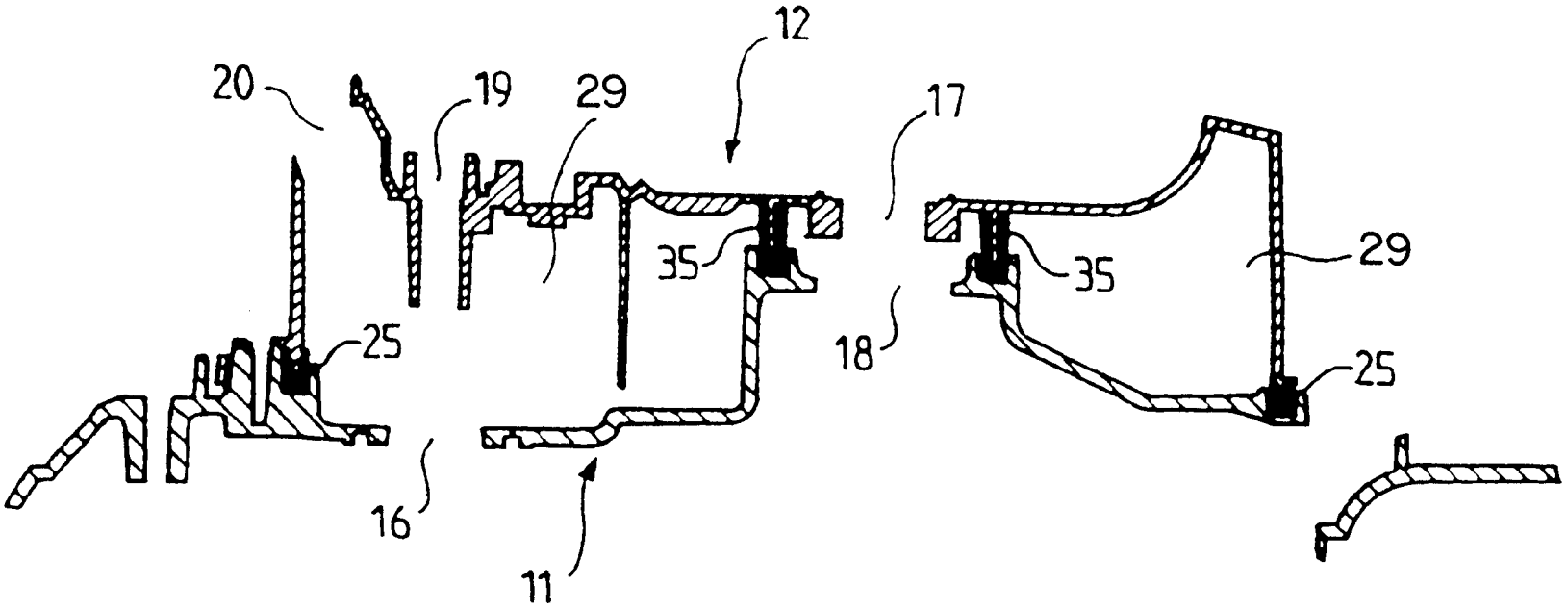
FIG. 8 is a side view in cross-section of a reservoir according to the second embodiment, after assembly.

FIG. 7 shows lower half-shell 11 and upper half-shell 12 before assembly. FIG. 8 shows lower half-shell 11 and upper half-shell 12 after assembly.

According to the construction example shown in FIGS. 7 and 8 the process consists in fixing in an irreversible manner a seal 25, 35 on each skirt 24, 34 before assembling lower half-shell 11 with upper half-shell 12 by inserting each seal 25, 35 in the corresponding groove 23, 33.

Advantageously according to a first embodiment of said process one of the coverings serving as a seal is obtained by overmolding on one of the annular conformations. Preferably each of the coverings serving as a seal is obtained by overmolding on or in one of the annular conformations. For example as shown in FIGS. 1 to 6 each seal 5, 15; 25, 35 is obtained by over molding on the associated annular conformation 4, 14; 24, 34 of upper half-shell 2; 12.

Advantageously also according to a second embodiment of said process one of the coverings serving as a seal is obtained with one of the half-shells by bi-injection molding. Preferably each of the coverings serving as a seal is obtained with one of the half-shells by bi-injection molding. For example, such as shown in FIGS. 1 to 6 each seal 5, 15; 25, 35 is obtained with the upper half-shell 2; 12 by bi-injection molding.

It is equally envisionable to obtain a seal or seals by bi-injection molding, and another seal or seals by overmolding.

It is also possible to obtain at least one seal by molding or conventional extrusion and to cement it or assemble it in a final manner to one of the half-shells of the reservoir.

It is also possible to obtain a seal or seals by bi-injection molding and/or by overmolding, and another seal or seals by conventional molding or extrusion, these latter seals being then cemented or assembled, for example to the upper half-shell of the reservoir.

The reservoir shown in FIGS. 7 and 8 equally presents in a known manner a filling orifice 20 arranged in upper half-shell 12, as well as orifices 16, 19 arranged respectively in lower 11 and upper 12 half-shells, provided to receive a device for injecting water into the steam chamber (not shown in the figures).

In the embodiment shown in FIGS. 7 and 8 a chamber 29 intended to receive the liquid is delimited by annular conformations 23, 33. These conformations in the form of a groove comprise a first rim 23', 33', disposed at the side of chamber 29 and a second rim 23", 33", disposed at the side opposite to chamber 29. Seals 25; 35 during the assembly operation are mounted in compression between rims 23', 23"; 33', 33". This arrangement permits a firm holding of the two half-shells to be obtained after assembly.

Advantageously one of the conformations opposed to that formed with one of the coverings serving as a seal presents at least one vent channel. Thus, the lower half-shell and/or the upper half-shell contain means to prevent air from remaining compressed under the seal or seals after the operation of assembling these two half-shells.

Figure 9:
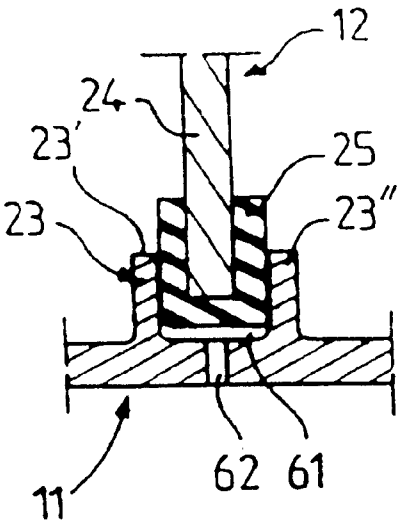
FIG. 9 is a cross-sectional view of a first embodiment of an improvement of the invention.

FIG. 9 shows a detail of a first example of construction of the above-cited means. Seal 25 shown on associated annular conformation 24 is maintained in compression by first rim 23' and second rim 23" of groove 23. A space 61 is obtained between seal 25 inserted into groove 23 and the bottom of said groove. A vent channel 62 formed by an orifice arranged in the bottom of groove 23 and traversing half-shell 11 permits space 61 to be placed in communication with the outside. This arrangement permits retention of air compressed under seal 25 to be avoided. Vent channel 62 does not disturb the sealing of the reservoir because it is isolated from the interior thereof by the wall of the seal. Advantageously several channels 62 are provided to place space 61 in communication with the outside. Two to four channels 62 per groove 23 are a good order of magnitude.

Figure 10A:
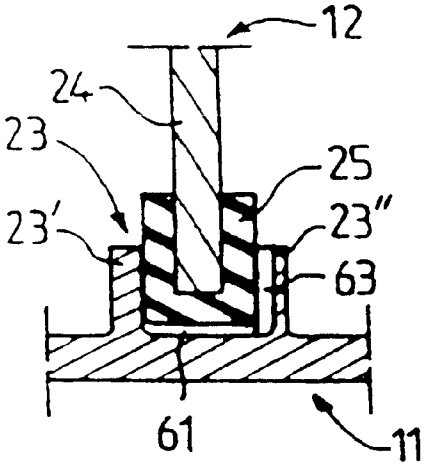
FIGS. 10*a* and 10*b* are two views in cross-section and from above of a second embodiment of an improvement according to the invention.
Figure 10B:
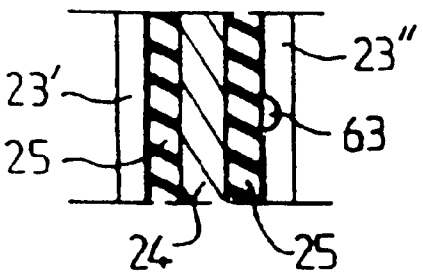

FIGS. 10*a* and 10*b* show a detail of a second example of construction of the above-cited means. Seal 25 mounted on associated annular conformation 24 is maintained in compression by first rim 23' and second rim 23" of groove 23. Space 61 obtained between seal 25 inserted into groove 23 and the bottom of said conformation is placed in communication with the outside by a lateral vent channel 62 arranged in the interior wall of rim 23" forming one of the vertical walls of groove 23. This solution presents the advantage of transferring a possible leak toward the top of the iron, into a less critical zone than in the preceding case.

Preferably vent channels 62; 63 do not open into a wall provided to form a part of a cavity intended to contain water or steam, such as chamber 29.

The preceding structural examples apply of course to any groove forming an annular conformation arranged in one of the half-shells. It is equally possible to envision a lateral vent channel on the wall of a skirt, or a vent channel arranged in the wall of said skirt an opening at the top of said skirt.

The means provided to prevent air from remaining compressed under the seal or seals 5, 15; 25, 35 after the assembly operation can include a closing of the vent channel openings 62; 63.

Figure 11:
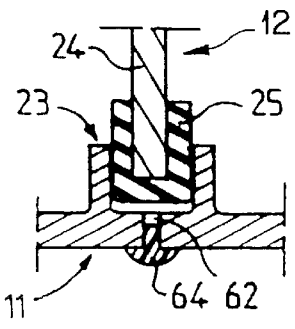
FIG. 11 is a cross-sectional view of a third embodiment of an improvement according to the invention.
Figure 12:
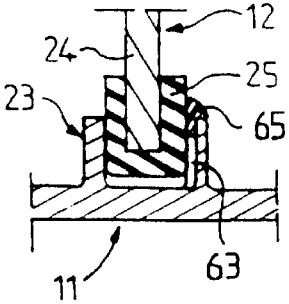
FIG. 12 is a cross-sectional view of a fourth embodiment of an improvement according to the invention.

FIG. 11 shows the construction presented in FIG. 9 completed by the blocking of vent channel 62 by means of an application of silicone 64. FIG. 12 shows the construction presented in FIG. 10*a* completed by the closing of channel 63 by means of an application of silicone 65. Such a closing permits greater latitude to be obtained in the choice of the placement of channel 62 or of channel 63, space 61 being closed and not being able to be invaded by water or by steam.

Thus, the invention equally concerns a process for producing a pressing iron reservoir in which at least one of the vent channels is closed after assembly of the upper half-shell 12 on the lower half-shell 11.

Figure 13:
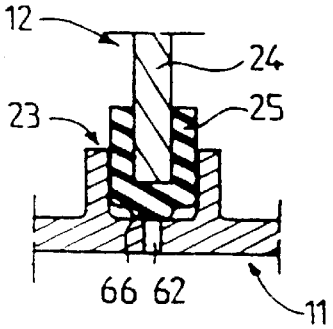
FIG. 13 is a view in cross-section of a fifth embodiment of an improvement according to the invention.
Figure 14:
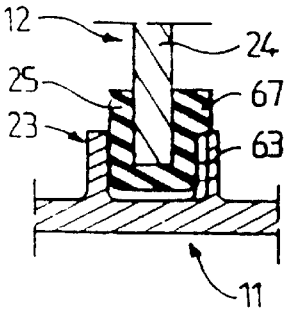
FIG. 14 is a cross-sectional view of a sixth embodiment of an improvement according to the invention.

Closing of the orifice can be equally obtained during the assembly operation with the aid of a protuberance arranged on the seal. As shown in FIG. 13, seal 25 includes a projecting part 66 provided to close channel 62 during assembly of groove 23 with skirt 24. As shown in FIG. 14, seal 25 is composed of a lateral projecting part 67 provided to close channel 63 at the time of assembly of groove 23 with skirt 24. Such a closing permits evacuation of a large part of the air present in space 61 between seal 25 and groove 23 at the time of the assembly operation and to avoid the existence of an overpressure in said space. It presents in addition the advantage of not requiring a supplemental operation.

Thus the present invention equally concerns a process for producing a pressing iron reservoir consisting in carrying out the assembly operation of the lower half-shell with the upper half-shell under partial vacuum.

Figure 15:
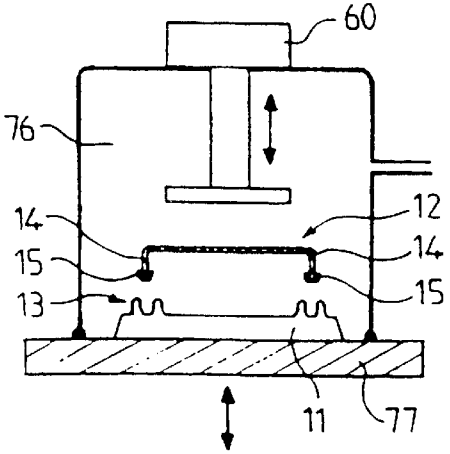
FIG. 15 is a schematic view of a device utilized for a process according to the invention.

FIG. 15 shows an illustration of a device provided for the assembly under vacuum of upper half-shell 12 and lower half-shell 11, in which only annular conformation 23 and associated annular conformation 24 including seal 25 are shown. A vacuum bell 76 is applied on a plate 77 on which is disposed lower half-shell 11. After the vacuum bell has been placed under a partial vacuum, a jack 60 comes to assemble the two half-shells 11, 12. Preferably the reservoir thus obtained is brought under atmospheric pressure before withdrawing the force of jack 60 in order to immediately utilize the effect of atmospheric pressure on the assembly of the two half-shells. By way of a variation the upper half-shell can be disposed on a plate having an appropriate form and the lower half-shell assembled by the jack on the upper half-shell.

Another process according to the present invention consists in placing in communication with the outside all of the space situated between a seal and an annular conformation. This operation permits achievement of a decompression of the space or spaces situated between each seal and each annular conformation.

This other process can consist for example in utilizing a lower half-shell 11 and an upper half-shell 12 capable of arranging at least one free passage 62, 63 between each seal 25 and each annular conformation 23, such as shown in FIGS. 9, 10*a* and 10*b*.

A variation, not shown in the figures, consists in creating said free passage, for example by piercing the lower half-shell in order to place in communication with the outside the space situated between the seal and the annular conformation, after the assembly operation.

Another variation, not shown in the figures, consists in arranging channel 63 intended to form a free passage on seal 25 and not on conformation 23.

In the case where the reservoir comprises several seals thus assembled, it is envisionable to utilize different variations to arrange a free passage between each seal and each corresponding annular conformation.

Such a process can equally include achievement of the assembly operation of the lower half-shell with the upper half-shell under partial vacuum.

Such a process can equally include a step consisting of closing the free passage or passages 62, 63 after the assembly operation. Thus the pressure existing at ambient temperature in the space situated between each seal 25 and each corresponding annular conformation 23 is of the order of magnitude of atmospheric pressure, even below if the closing 64, 65, 66, 67 of the free passage or passages 62, 63 is achieved under partial vacuum.

The invention is not in any way strictly limited to the examples of construction described previously, but encompasses numerous modifications and improvements.

Notably it is envisionable to only utilize a single seal, for example according to the example of construction represented in FIGS. 1 to 3 only seal 5, annular conformations 13 and 14 not being indispensable since orifice 7 is situated in any event outside of the reservoir.

It is equally envisionable to provide the covering on only a part of an annular conformation of the lower half-shell and in a complementary manner on a corresponding part of the annular conformation associated with the upper half-shell.

POSSIBILITY OF INDUSTRIAL APPLICATION

The invention finds its application in the technical field of household electric steam appliances and in particular steam irons.

What is claimed is:

1. Pressing iron reservoir comprising a lower half-shell (1; 11) having at least one annular conformation (3, 13; 23, 33) and an upper half-shell (2; 12) having at least one annular conformation (4, 14; 24, 34) provided to interengage in and/or above the corresponding annular conformation (3, 13; 23, 33) of the lower half-shell (1; 11), characterized in that at least one (4, 14; 24, 34) of the conformations (3, 13; 23, 33; 4, 14; 24, 34) is formed with a covering attached in an irreversible manner and serving as a seal (5, 15; 25, 35).

2. Pressing iron reservoir according to claim 1, characterized in that the at least one annular conformation (3, 13; 23, 33) formed on the lower half-shell (1; 11) is a groove, and that the corresponding at least one conformation (4, 14; 24, 34) of the upper half-shell (2; 12) is a skirt.

3. Pressing iron reservoir according to claim 1, characterized in that the at least one annular conformation arranged on the lower half-shell (1; 11) is a skirt, and that the corresponding at least one annular conformation of the upper half-shell (2; 12) is a groove.

4. Pressing iron according to claim 3, characterized in that the covering serving as a seal is disposed in the groove.

5. Pressing iron reservoir according to claim 3, characterized in that the covering serving as a seal (5, 15; 25, 35) is disposed on the skirt.

6. Pressing iron reservoir according to one of claims 1 to 5, characterized in that the covering or one of the coverings serving as a seal (5, 15; 25, 35) has a thickness between 0.5 and 5 mm.

7. Pressing iron reservoir according to claim 1, characterized in that the covering or one of the coverings serving as a seal (5, 15; 25, 35) is made of an ethylene propylene diene monomer.

8. Pressing iron reservoir according to one of claims 1 to 7, characterized in that the lower half-shell (1) includes a first annular conformation (3) and a second annular conformation (13) adjacent to the first annular conformation (3), and that the upper half-shell (2) comprises a first annular conformation (4) and a second annular conformation (14) adjacent to the first annular conformation (4).

9. Pressing iron reservoir according to claim 8, characterized in that a first covering serving as a seal (5) is disposed in or on the first annular conformation (4) of the upper half-shell (2), and a second covering serving as a seal (15) is disposed in or on the second annular conformation (14) of the upper half-shell (2).

10. Pressing iron reservoir according to one of claims 1 to 7, characterized in that the lower half-shell (11) includes a peripheral annular conformation (23) and an interior annular conformation (33), and that the upper half-shell (12) comprises a peripheral annular conformation (24) and an interior annular conformation (34).

11. Pressing iron reservoir according to claim 10, characterized in that a covering serving as a seal (25) is disposed in or on the peripheral annular conformation (24) of the upper half-shell (12), and another covering serving as a seal (35) is disposed in or on the interior annular conformation (34) of the upper half-shell (12).

12. Process for producing a pressing iron reservoir according to one of claims 1 to 11, characterized in that the covering or one of the coverings serving as a seal (5, 15; 25, 35) is obtained by overmolding on the annular conformation or one of the annular conformations (4, 14; 24, 34).

13. Process for producing a pressing iron reservoir according to one of claims 1 to 11, characterized in that the covering or one of the coverings serving as a seal (5, 15; 25, 35) is obtained with one (2; 12) of the half-shells by bi-injection molding.

14. Process for producing a pressing iron reservoir according to one of claims 1 to 11, characterized in that the covering or one of the coverings serving as a seal (5, 15; 25, 35) is obtained by conventional molding or extrusion then cemented or assembled in a final manner with the one (2; 12) of the half-shells.

15. Pressing iron reservoir according to one of claims 1 to 11, characterized in that the conformation or the one of the conformations (12) opposed to that (11) produced with the covering or the one of the coverings serving as a seal (25) has at least one vent channel (62; 63).

16. Reservoir for a pressing iron according to claim 7, characterized in that the conformation or one of the conformations (12) opposed to that (11) produced with the covering or the one of the coverings serving as a seal (25) is a groove having a base and has at least one vent channel (62; 63) and the vent channel or one of the vent channels (62) starts from the base of the groove and traverses the half-shell (11).

17. Reservoir for a pressing iron according to claim 7, characterized in that the conformation or one of the conformations (12) opposed to that (11) produced with the covering or the one of the coverings serving as a seal (25) is a groove having vertical walls and has at least one vent channel (62; 63) and the vent channel or one of the vent channels (63) is arranged in one of the vertical walls of the groove.

18. Reservoir for a pressing iron according to claim 15, characterized in that the covering or the one of the coverings (25) serving as a seal presents an extra thickness (66; 67) provided to come to block the vent channel or the one of the vent channels (62; 63).

19. Process for producing a pressing iron reservoir according to claim 15, comprising: assembling the upper half-shell (12) on the lower half-shell (11); and blocking the vent channel or the one of the vent channels after said assembling step.

20. Process for producing a pressing iron reservoir according to claim 1, comprising assembling the lower half-shell with the upper half-shell under partial vacuum.

21. Device for the assembly process according to claim 20, comprising a vacuum bell (76), a pump, a plate (77) provided to receive a lower (11) or upper half-shell, a jack (60) provided to assemble an upper (12) or lower half-shell onto the lower (11) or upper half-shell, a vacuum bell (76), a pump.

22. Pressing iron according to claim 2, characterized in that the covering serving as a seal is disposed in the groove.

23. Pressing iron reservoir according to claim 2 characterized in that the covering serving as a seal is disposed on the skirt.

* * * * *